US006990990B2

(12) United States Patent
Wilensky et al.

(10) Patent No.: US 6,990,990 B2
(45) Date of Patent: Jan. 31, 2006

(54) WALKER WITH SUPPORT HANDLE

(76) Inventors: Glen R. Wilensky, 8710 Avalon Dr., Richmond, VA (US) 23229; John F. Miller, 12409 Avon Lake Cir., Midlothian, VA (US) 23114

( * ) Notice: Subject to any disclaimer, the term of this patent is extended or adjusted under 35 U.S.C. 154(b) by 0 days.

(21) Appl. No.: 10/376,978

(22) Filed: Feb. 28, 2003

(65) Prior Publication Data

US 2003/0178053 A1 Sep. 25, 2003

Related U.S. Application Data

(60) Provisional application No. 60/361,235, filed on Mar. 1, 2002.

(51) Int. Cl.
*A61H 3/00* (2006.01)

(52) U.S. Cl. ..... 135/67; 135/71; 135/72

(58) Field of Classification Search ..... 135/67, 135/71, 72, 73, 76, 65
See application file for complete search history.

(56) References Cited

U.S. PATENT DOCUMENTS

| | | | | | |
|---|---|---|---|---|---|
| 1,400,394 | A | * | 12/1921 | Warry | 135/69 |
| 2,690,188 | A | * | 9/1954 | Goddard | 135/72 |
| 2,741,255 | A | * | 4/1956 | Neptune | 135/72 |
| 2,855,024 | A | * | 10/1958 | Robb | 135/67 |
| 3,289,685 | A | * | 12/1966 | McCall Parker | 135/65 |
| 3,417,765 | A | * | 12/1968 | Slater | 135/69 |
| 3,635,233 | A | * | 1/1972 | Robertson | 135/71 |
| 3,727,482 | A | * | 4/1973 | Geer | 74/531 |
| 3,768,495 | A | * | 10/1973 | Smith | 135/72 |
| 4,170,909 | A | * | 10/1979 | Wagner | 81/63.2 |
| 4,187,869 | A | * | 2/1980 | Marchetti | 135/67 |
| 4,248,256 | A | * | 2/1981 | Thomas | 135/67 |
| 4,341,381 | A | * | 7/1982 | Norberg | 482/67 |
| 4,748,994 | A | * | 6/1988 | Schultz et al. | 135/67 |
| 4,869,280 | A | * | 9/1989 | Ewing | 135/69 |
| 4,993,446 | A | | 2/1991 | Yarbrough | |
| 5,005,599 | A | | 4/1991 | Cunningham | |
| 5,201,333 | A | * | 4/1993 | Shalmon et al. | 135/67 |
| 5,277,438 | A | * | 1/1994 | Chuang | 280/42 |
| 5,339,850 | A | * | 8/1994 | Mertz | 135/72 |
| 5,445,174 | A | | 8/1995 | Cunningham | |
| 5,465,744 | A | | 11/1995 | Browning | |
| 5,482,070 | A | * | 1/1996 | Kelly | 135/66 |
| 5,657,783 | A | | 8/1997 | Sisko et al. | |
| 5,845,664 | A | * | 12/1998 | Ryder et al. | 135/65 |
| 5,862,825 | A | * | 1/1999 | Leonard | 135/67 |
| 6,055,997 | A | * | 5/2000 | Greenstadt et al. | 135/65 |
| 6,082,384 | A | | 7/2000 | Cheng | |
| 6,085,766 | A | * | 7/2000 | Geary | 135/75 |
| 6,279,591 | B1 | | 8/2001 | Obitts | |
| 6,311,942 | B1 | * | 11/2001 | Rotter et al. | 248/316.5 |
| 6,338,493 | B1 | * | 1/2002 | Wohlgemuth et al. | 280/30 |
| 6,371,142 | B1 | * | 4/2002 | Battiston | 135/67 |
| 6,453,921 | B1 | * | 9/2002 | Rost | 135/67 |
| 6,733,018 | B2 | * | 5/2004 | Razon | 280/87.021 |
| 2003/0098052 | A1 | * | 5/2003 | Fismer | 135/76 |

FOREIGN PATENT DOCUMENTS

GB 2206183 A * 12/1988

OTHER PUBLICATIONS

Color photographs of walker (undated).
WIPO, International Search Report date Jun. 29, 2004, International Patent Application No. PCT/US03/07309, 1 page.

* cited by examiner

*Primary Examiner*—Kimberly T. Wood
(74) *Attorney, Agent, or Firm*—Hunton & Williams LLP

(57) ABSTRACT

A walker for aiding an individual rising from or returning to a seated position is disclosed. The walker comprises a frame structure including a first side frame having a first anterior leg and a first posterior leg, a second side frame having a second anterior leg and a second posterior leg, and a center frame connecting the first side frame and the second side frame. The walker further includes a first support assembly attached to the first anterior leg of the first side frame, the first support assembly including a first support handle being rotatable in a plane substantially perpendicular to the axis of the first anterior leg. Thus, the first support handle is effective in aiding the individual rising from or returning to the seated position.

6 Claims, 8 Drawing Sheets

WALKER WITH SUPPORT HANDLE

The present invention claims priority to U.S. Provisional Application No. 60/361,235 filed Mar. 1, 2002, the contents of which are incorporated herein by reference in their entirety.

BACKGROUND OF THE INVENTION

The present invention is directed to an accessory handle, or support handle, for use with a standard or folding walker.

Most individuals who utilize a walker require some form of support and assistance when rising from or returning to a seated position. No difficulty is found if the seated position includes armrests for which the individual is able to place one or both hands to improve the leverage and safety of rising or lowering. However, if the seated position has no armrests, individuals may experience great difficulty rising or lowering themselves. This is especially true when an individual may be seated on items such as a toilet, low couch, bed, or armless chairs.

It is therefore desirable to have a device which will assist individuals who utilize a walker in rising and lowering themselves from seated positions. Such a device would allow them increased seating options, and increased independence for their daily lives.

SUMMARY OF THE INVENTION

In accordance with a first embodiment of the invention, a walker for aiding an individual rising from or returning to a seated position is disclosed. The walker comprises a frame structure including at least one leg having an axis, and a support assembly attached to the first leg, the support assembly including a handle being rotatable in a plane substantially perpendicular to the axis of the first leg. The handle is effective in aiding the individual rising from or returning to the seated position.

In accordance with a second embodiment of the invention, a walker for aiding an individual rising from or returning to a seated position is disclosed. The walker comprises a frame structure including a first side frame having a first anterior leg and a first posterior leg, a second side frame having a second anterior leg and a second posterior leg, and a center frame connecting the first side frame and the second side frame. The walker further includes a first support assembly attached to the first anterior leg of the first side frame, the first support assembly including a first support handle being rotatable in a plane substantially perpendicular to the axis of the first anterior leg. Thus, the first support handle is effective in aiding the individual rising from or returning to the seated position.

In accordance with a third embodiment of the invention, a walker for aiding an individual rising from or returning to a seated position is disclosed. The walker comprises a frame structure including a first side frame having a first anterior leg and a first posterior leg, a second side frame having a second anterior leg and a second posterior leg, and a center frame connecting the first side frame and the second side frame. The walker further includes a first support assembly attached to the first anterior leg of the first side frame, the first support assembly including a first support handle being rotatable in a plane substantially perpendicular to the axis of the first anterior leg. Further, the walker includes a second support assembly attached to the second anterior leg of the second side frame, the second support assembly including a second support handle being rotatable in a plane substantially perpendicular to the axis of the second anterior leg. The first support handle and second support handle are effective in aiding the individual rising from or returning to the seated position.

In accordance with a fourth embodiment of the invention, a walker for aiding an individual rising from or returning to a seated position is disclosed. The walker comprises a frame structure including a first side frame having a first anterior leg and a first posterior leg, a second side frame having a second anterior leg and a second posterior leg, and a center frame connecting the first side frame and the second side frame. The walker further includes a first support assembly attached to the first posterior leg of the first side frame, the first support assembly including a first support handle being rotatable in a plane substantially perpendicular to the axis of the first posterior leg. Further, the walker includes a second support assembly attached to the second posterior leg of the second side frame, the second support assembly including a second support handle being rotatable in a plane substantially perpendicular to the axis of the second posterior leg. The first support handle and second support handle are effective in aiding the individual rising from or returning to the seated position.

BRIEF DESCRIPTION OF THE DRAWINGS

The present invention can be more fully understood by reading the following detailed description of the presently preferred embodiments together with the accompanying drawings, in which like reference indicators are used to designate like elements, and in which.

DETAILED DESCRIPTION OF PREFERRED EMBODIMENTS

Figure 1:
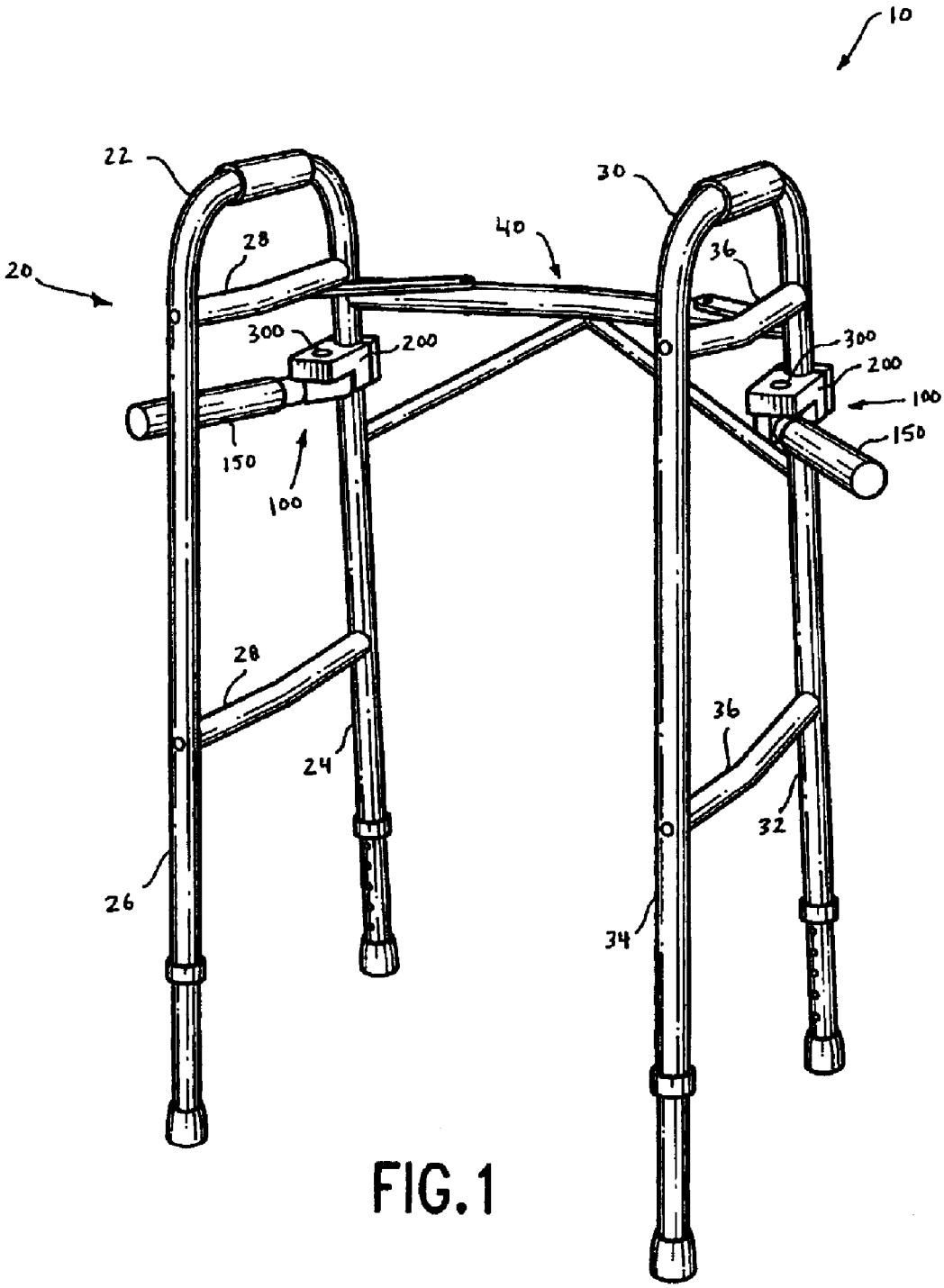
FIG. 1 is a perspective view of an illustrative walker in accordance with one embodiment of the invention.

FIG. 1 is a perspective view of an illustrative walker in accordance with one embodiment of the invention. As shown in FIG. 1, walker 10 includes frame structure 20 comprised of first side frame 22 and second side frame 30. First side frame 22 has a first anterior leg 24, a first posterior leg 26, and a pair of side supports 28. Second side frame 30 has a second anterior leg 32, a second posterior leg 34, and a pair of side supports 36. Center frame 40 connects first side frame 22 and second side frame 30. It should be appreciated that walker 10 may comprise a standard or folding or collapsible walker, as well as any other known walkers to the extent they are not inconsistent with the invention.

A pair of support assemblies 100 are attached to the first anterior leg 24 and the second anterior leg 32 for aiding an individual using the walker 100 in rising from or lowering into a seated position (such as a chair, bed, toilet, for example). Each support assembly 100 includes a support handle 150 and collar assembly 200. Collar assembly 200 includes collar body 210 and collar clamp 250, which encircle and secure the support assembly 100 to the first anterior leg 24 and the second anterior leg 32. Handle 150 is pivotably attached to the collar assembly 200 by a pivot member 300 such that handle 150 may pivotally rotate in a plane substantially perpendicular to the axis of the walker legs. Handle 150 may be rotated over a fixed range, from a neutral position, towards the exterior of the walker and the support position, and also towards the interior of the walker. For the first side frame 22, handle 150 in the neutral position is preferably disposed between the first anterior leg 24 and the first posterior leg 26 and parallel to side supports 28. For the second side frame 30, handle 150 in the neutral position is preferably disposed between the second anterior leg 32 and the second posterior leg 34 and parallel to side supports 36.

Handle 150 and the other components of support assembly 100 may be constructed from any suitable material with good mechanical properties, such as may be required to support the weight of a person using the handles as support to rise or lower from or to a seated position. Preferably, the material should also be lightweight, for example, aluminum, graphite composite, or various polymers known to those in the art as suitable for such applications as those described herein.

Figure 2:
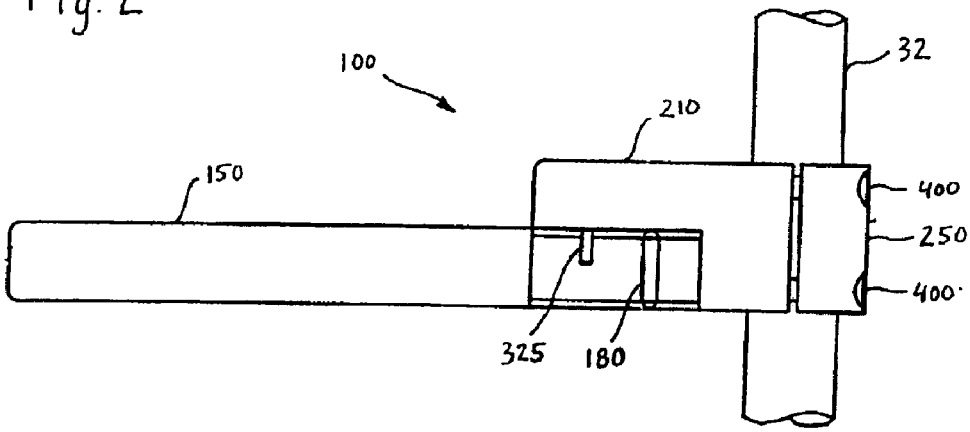
FIG. 2 is a side view of the support assembly of FIG. 1 in further detail in accordance with one embodiment of the invention.

FIG. 2 is a side view of the support assembly of FIG. 1 in further detail in accordance with one embodiment of the invention. As shown in FIG. 2, support assembly 100 is in the neutral position with respect to second anterior leg 32. Collar clamp 250 and collar body 210 are attached by machine screws 400 around second anterior leg 32. It should, however, be appreciated that collar body 210 and collar clamp 250 may be joined around second anterior leg 32 by any means of attachment that provides the requisite stability. Additional stability may optionally be gained by utilizing a setscrew disposed through collar clamp 250 to apply a normal force against the leg 32 to prevent rotational motion of the collar assembly 200 about the leg 32. Pivot stop 325 is disposed in collar body 210 to restrict the rotational movement of handle 150 when pivot stop 325 engages pivot stop detent 180. It should be appreciated that in at least one embodiment of the invention, for each support assembly 100, only one pivot stop 325 may be utilized. Thus, handle 150 is provided with secondary pivot stop 181 that may be further used to restrict the rotation of handle 150.

Figure 3:
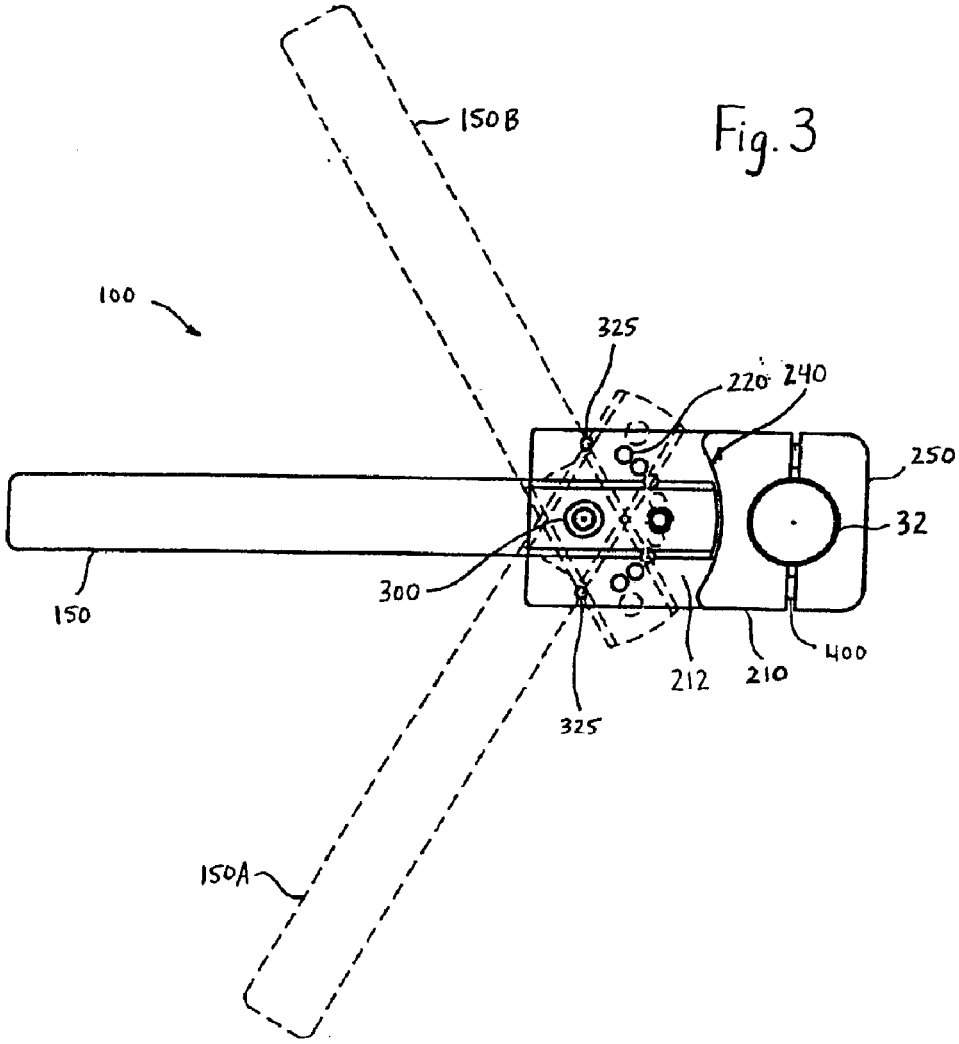
FIG. 3 is an underside view of the support assembly of FIG. 1 in further detail in accordance with one embodiment of the invention.

FIG. 3 is an underside view of the support assembly of FIG. 1 in further detail in accordance with one embodiment of the invention. Handle 150 is disposed in a plane parallel to an inferior surface 212 of collar body 210. As described above, handle 150 is attached to the inferior surface 212 of collar body 210 by pivot member 300, as shown in FIG. 3. In this embodiment, pivot member 300 is a pin attaching handle 150 and collar body 210. It should be appreciated that pivot member 300 may be any type of securing means that allows handle 150 to rotate in the plane substantially perpendicular to the axis of the leg 32. For example, pivot member 300 may also be a screw, bolt secured by washer and nut arrangement, or other suitable piece which serves to attach collar body 210 and handle 150.

As shown in FIG. 3, handle 150 is in the neutral position. Handle 150 may be displaced a fixed range of degrees from the neutral position internal (toward the center of the walker) to the support position shown by handle 150B, or from the neutral position external (away from the walker) to the support position shown by 150A (as illustrated in FIG. 1). The displacement is limited by pivot stop 325 which is affixed to the inferior surface 212 of collar body 210. It should be appreciated other degrees of rotational displacement may be utilized in further embodiments by changing the location of the pivot stop 325 or removing it altogether.

In at least one embodiment of the invention, handle 150 may be rotated to a support position existing anywhere in a range of about ninety (90) degrees from the neutral position internal, and to about forty-five (45) degrees from the neutral position external. Accordingly, the ranges described are merely exemplary, and may be adjusted over any fixed range. This may include an embodiment that does not utilize a collar assembly and attaches directly to the walker leg, providing substantially three hundred sixty (360) degrees of rotation, to suit the intended purpose of the skilled artisan.

It should also be appreciated that there may be deflection in the vertical direction when handle 150 is used to support the weight of an individual. In further embodiments, handle 150 may be disposed at angle that is not perpendicular to the axis of the walker leg to which the support assembly is attached, i.e., at some angle between the vertical axis of the walker leg and the normal to the walker leg axis. However, in such embodiments, the handle would still rotate around an axis (pivot member) substantially parallel with the vertical axis of the walker leg.

Figure 4:
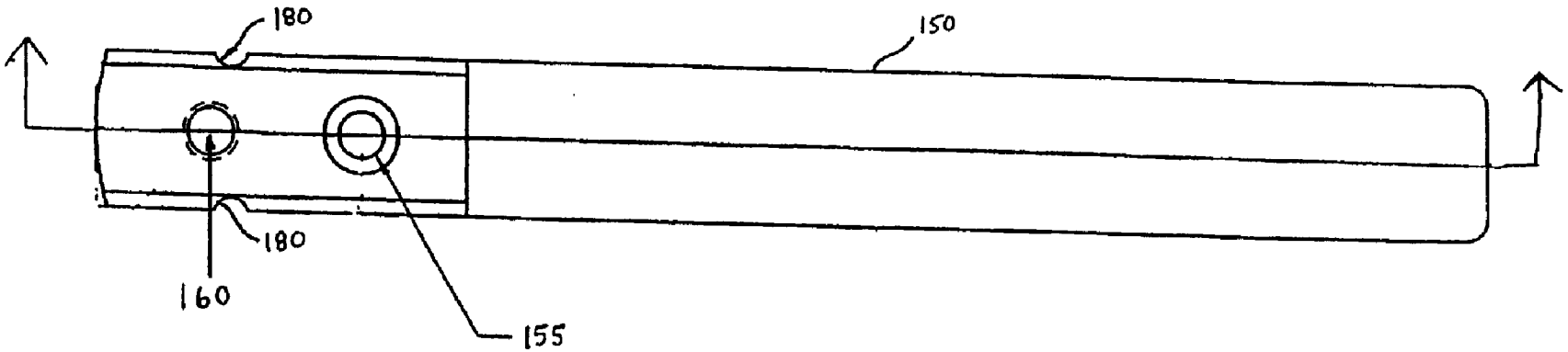
FIG. 4 is an underside view of the handle of FIG. 1 in further detail in accordance with one embodiment of the invention.

FIG. 4 is an underside view of the handle of FIG. 1 in further detail in accordance with one embodiment of the invention. As shown in FIG. 4, handle 150 is preferably one integral piece, substantially cylindrical, except for the end of handle 150 at which collar body 210 is attached, is preferably box-like to provide additional strength. Handle 150 also has pivot bore 155 through which pivot member 300 may be inserted to attach handle 150 to collar body 210. Handle 150 includes a secondary bore 160, into which a spring tension system with a spring tension member, a spring and a bearing, or other similar device is inserted. This spring tension system creates a temporary securing arrangement through interaction with a series of detents 220 on the inferior surface 212 of collar body 210 that urges the bearing of the spring tension system to rise into the detents 220 and secures the support handle 150 at a desired angled position from neutral.

Figure 5:
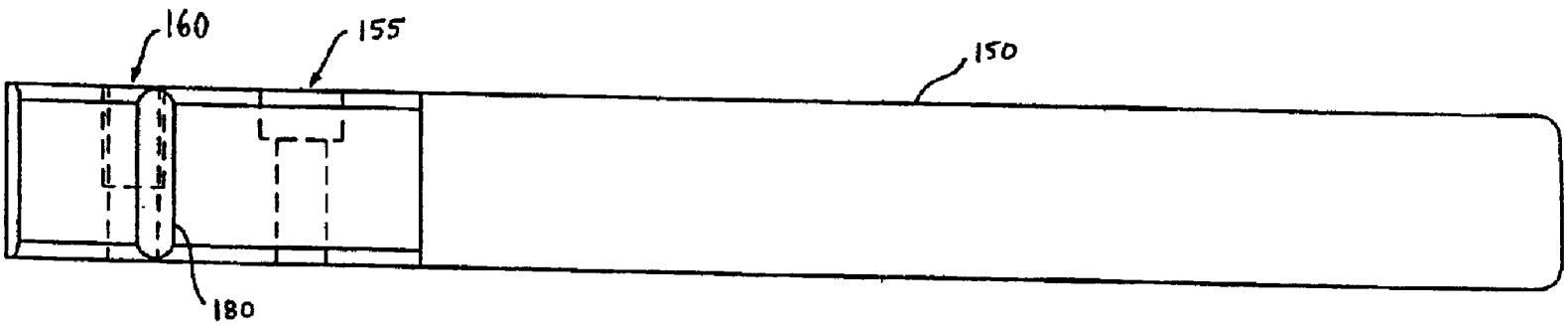
FIG. 5 is a side view of the handle of FIG. 1 in further detail in accordance with one embodiment of the invention.

FIG. 5 is a side view of the handle of FIG. 1 in further detail in accordance with one embodiment of the invention. As described above, handle 150 includes pivot stop detent 180 and secondary pivot stop detent 181. Pivot stop detent 180 receives pivot stop 325, as handle 150 is rotated until it contacts pivot stop 325. Handle 150 may also be fitted with a grip, which may be constructed from foam rubber or like materials.

Figure 6A:
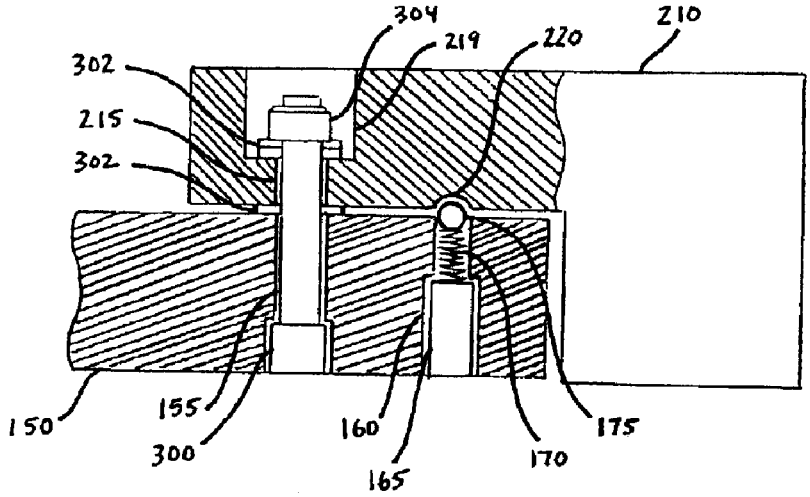
FIG. 6A is a side sectional view of the handle of FIGS. 2 and 3 with the collar assembly in accordance with one embodiment of the invention.
Figure 6B:
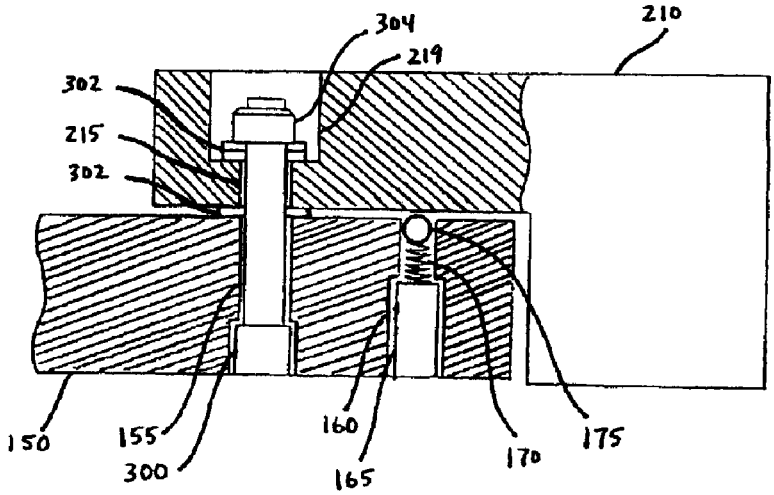
FIG. 6B is a side sectional view of the handle of FIGS. 2 and 3 with the collar assembly in accordance with one embodiment of the invention.

FIGS. 6A and 6B are side sectional views of handle 150 of FIGS. 2 and 3 with collar body 210 in accordance with one embodiment of the invention. The partial sectional views shown in FIGS. 6A and 6B are over range 6' to 6' from FIG. 4. Pivot member 300 connects handle 150 to collar body 210. In this embodiment, pivot member 300 is a bolt threaded through and secured by nut 304, and spaced by washers 302 inside countersink 219 above pivot member bore 215. A cap (not illustrated) may be used to cover countersink 219 and the components therein.

Bearing 175 is at least partially disposed within secondary bore 160, with tension member 165. Tension member 165 may be a pin, screw (threaded into bore 160), or an other device capable of holding spring 170 and bearing 175 in tension. Spring 170 is situated between bearing 175 and tension member 165. As handle 150 is rotated about pivot member 300, bearing 175 is primarily contained within secondary bore 160, compressing spring 170 against tension member 165. As handle 150 pivots such that handle 150 passes over a detent 220, bearing 175 rises from the secondary bore 160 into detent 220, spring 170 correspondingly decompresses, and handle 150 is secured in place (as shown in FIG. 6A) until sufficient lateral force is applied to force bearing 175 to recede into secondary bore 160, recompressing spring 170 (as shown in FIG. 6B). Alternatively, the spring tension system could simply comprise a spring loaded locking pin inserted through secondary bore 160.

Figure 7:
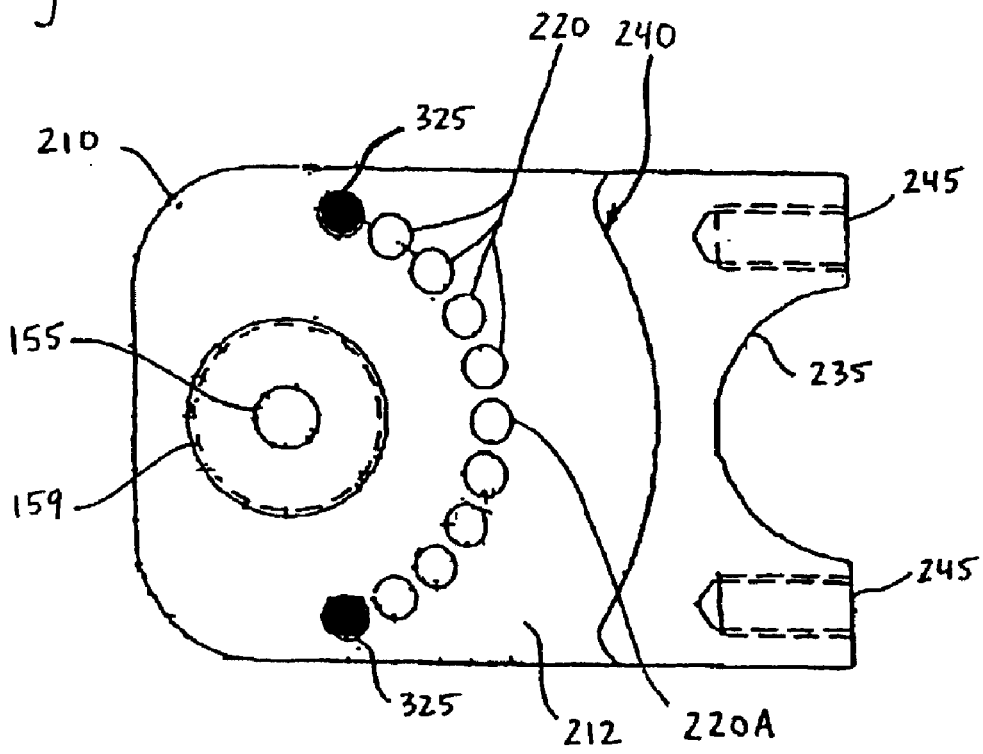
FIG. 7 is an underside view of the collar body of FIGS. 2 and 3 in further detail without the support handle attached in accordance with one embodiment of the invention.

FIG. 7 is an underside view of the collar body of FIGS. 2 and 3 in further detail in accordance with one embodiment of the invention. As described above, collar body 210 includes pivot member bore 215, which is configured to accept pivot member 300. Collar body 210 also includes countersink 219, which may be used to secure pivot member 300 such that handle 150 is secured to collar body 310. For example, in one embodiment, pivot member 300 may comprise a bolt, and a nut may be secured to the bolt within countersink 219 to increase the strength of the attachment between collar body 210 and handle 150.

A plurality of detents 220 are disposed on the inferior surface 212 of collar body 210, as shown in FIG. 7. As handle 150 is rotated about pivot member 300, a spring tension system holds handle 150 in contact with the collar body 210, as described above in reference to FIGS. 6A and 6B. Handle 150 is held in place (at a fixed degree of rotation) by the force of the decompressed spring 170 holding the bearing 175 in the detent 220 until sufficient lateral force is applied to cause the spring 170 to compress and consequently cause the bearing 175 to recede from the detent 220 into the secondary bore 160, at which point the handle 150 slides relative to the inferior surface 212 of the collar body 210 until the bearing 175 rises into another detent 220. Additionally, it should be appreciated that when an individual uses handle 150 to support his weight, the downward force on handle 150 causes the spring tension system and bearing 175 to further secure the handle at the support position. The number of detents 220 determines the number of discrete angles at which handle 150 may be oriented with respect to the neutral position. At least one detent 220A is preferably placed for alignment of handle 150 in the neutral position, so that handle 150 may be secured in the neutral position when not in use.

It should be appreciated that pivot stops 325 may be positioned at any point on the collar body 210, but are preferably positioned on the inferior surface along the same arc formed by detents 220. Pivot stop 325 may be a cylindrical rod or bolt which is attached to the collar body 210 and prevents handle 150 from rotating beyond the point at which pivot stop 325 is disposed. Pivot stop 325 may be permanently attached, by welding or brazing for example, or may be removably attached, for example, by inserting a threaded pivot stop into a threaded bore through the inferior surface 212 of collar body 210. If multiple threaded bores are placed through collar body 210, pivot stop 325 can be placed at various locations to variously restrict the range of motion when handle 150 is pivoted.

In this embodiment, collar body 210 has leg arch 235 formed within it. Leg arch 235 is substantially semi-circular (as shown in FIG. 7) and is constructed to partially fit around, or engage one of the walker legs. Additionally, in the embodiment shown, collar body 210 has handle arch 240 formed within it. Handle arch 240 allows handle 150 to rotate freely at a fixed distance from collar body 210.

Figure 8:
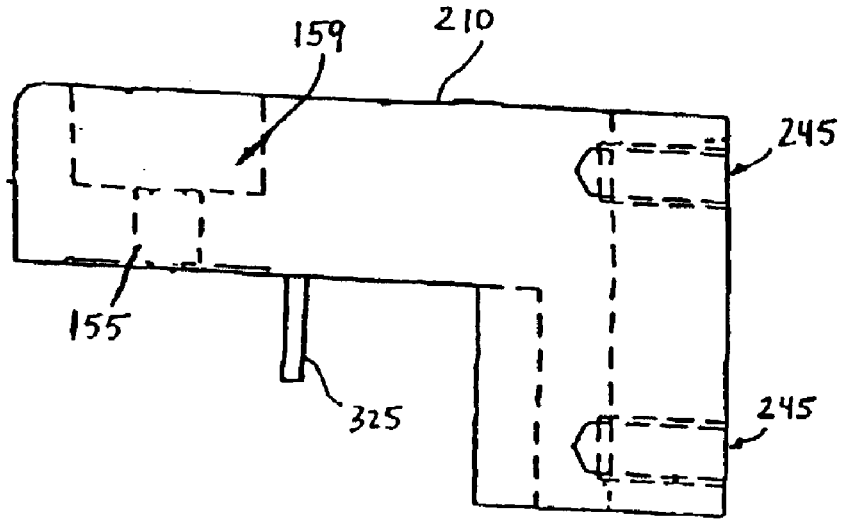
FIG. 8 is a side view of the collar body of FIGS. 2 and 3 in further detail without the support handle attached in accordance with one embodiment of the invention.
Figure 9:
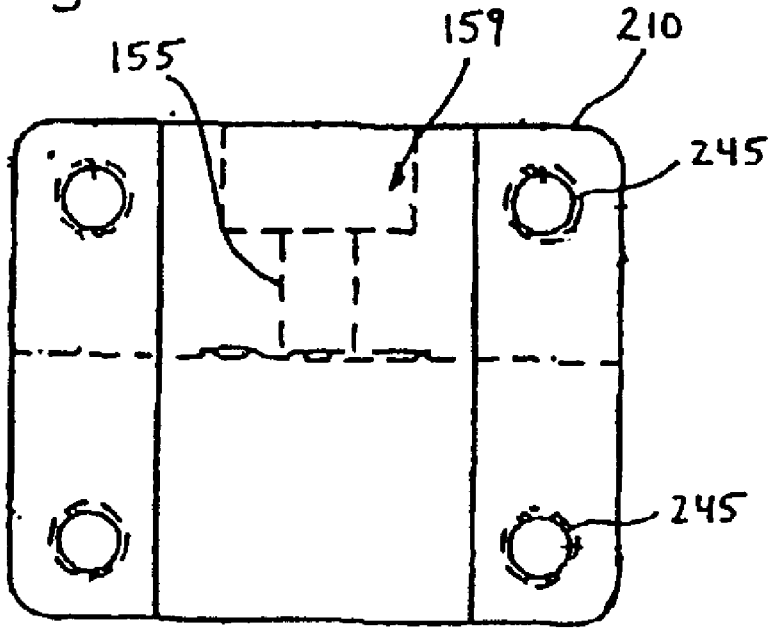
FIG. 9 is an inside frontal view of the collar body of FIGS. 2 and 3 in further detail in accordance with one embodiment of the invention.

FIGS. 8 and 9 illustrate collar body 210 of FIGS. 2 and 3 in further detail in accordance with one embodiment of the invention. FIG. 8 is a side view of collar body 210, while FIG. 9 is an inside frontal view of collar body 210. As shown in FIGS. 8–9, collar body 210 includes bored holes 245 for receiving machine screws 400 to attach collar body 210 to collar clamp 250 of collar assembly 200.

Figure 10:
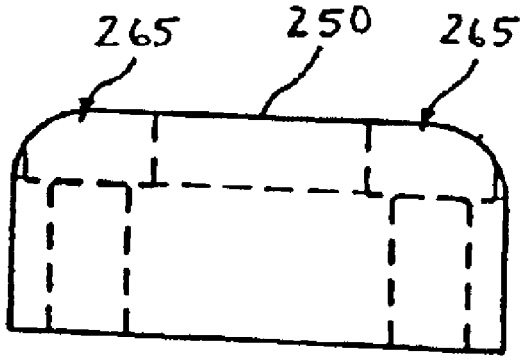
FIG. 10 is a side view of the collar clamp of FIGS. 2 and 3 in further detail in accordance with one embodiment of the invention.
Figure 12:
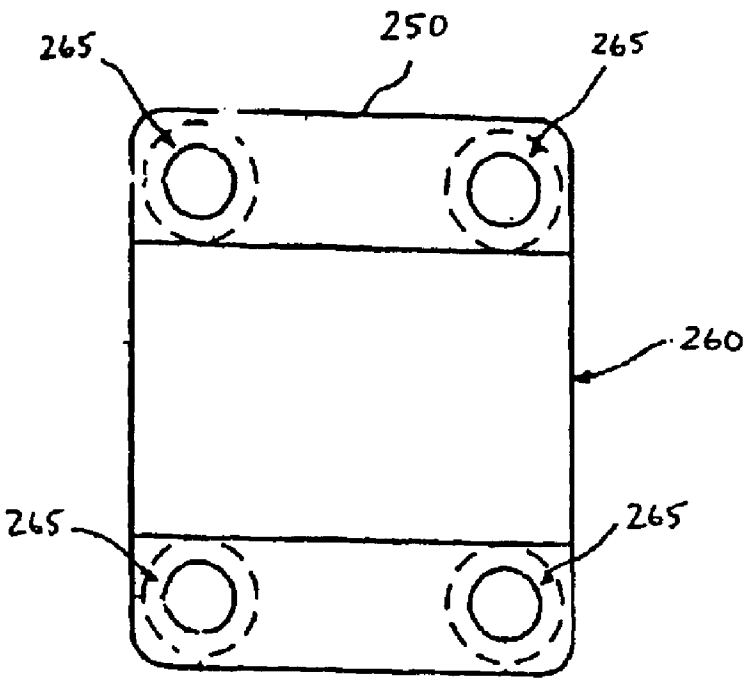
FIG. 12 is an inside frontal view of the collar clamp of FIGS. 2 and 3 in further detail in accordance with one embodiment of the invention.
Figure 11:
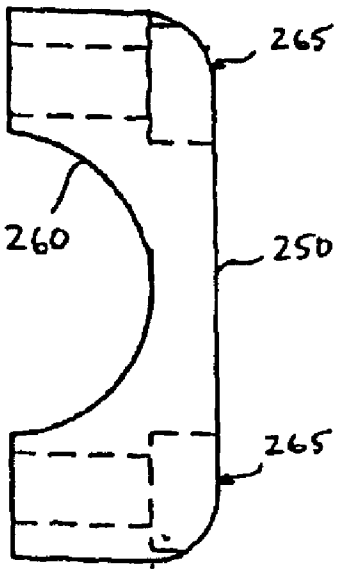
FIG. 11 is an underside view of the collar clamp of FIGS. 2 and 3 in further detail in accordance with one embodiment of the invention.

FIGS. 10, 11 and 12 illustrate collar clamp 250 of FIGS. 2 and 3 in further detail in accordance with one embodiment of the invention. FIG. 10 is a side view of collar clamp 250, while FIG. 11 is an underside view, and FIG. 12 is an inside frontal view. Collar clamp 250 has leg arch 260 formed within it, which is complementary to leg arch 235 of collar body 210 for fitting around one of the walker legs. In this embodiment, collar clamp 250 includes complementary bored holes 265 that extend through both front and back vertical surfaces of collar clamp 250. Collar clamp 250 is attached to collar body 210 by inserting machine screws 400 through bored holes 265 of collar clamp 250 into bored holes 245 of collar body 210.

It should be appreciated that other means of attaching collar body 210 to collar clamp 250 to form collar assembly 200 around one of the walker legs include any equivalent removable fasteners known to those skilled in the art including, but not limited to, bolts and buckles. Additionally, the collar assembly may be permanently attached around a walker leg such as by welding, brazing, use of an epoxy-resin, or other equivalent methods known to those in the art.

While the support assembly may be positioned on one of the walker legs by a qualified technician, such as a doctor, therapist, or other skilled practitioner, it should further be appreciated that certain safety design changes may be made on further embodiments of the invention, including the rounding of edges on the collar assembly, for example.

Many embodiments and adaptations of the present invention other than those herein described, will be apparent to those skilled in the art by the foregoing description thereof, without departing from the substance or scope of the invention. While the present invention has been described herein in detail in relation to its exemplary embodiments, it is to be understood that this disclosure is only illustrative and exemplary of the present invention. Accordingly, the foregoing disclosure is not intended to limit the scope of the present invention which is defined by the claims and their equivalents.

What is claimed is:

1. A walker for aiding and individual rising from a returning to a seated position, the walker comprising:

a frame structure including;

a first side frame having a first anterior leg and a first posterior leg connected at a first upper portion, a second side frame having a second anterior leg and a second posterior leg connected at a second upper portion, a center frame connecting the first side frame and the second side frame;

a first support assembly attached to the first anterior leg of the first side frame, the first support assembly including a first support handle and a first collar assembly having a first collar body portion and a first collar clamp portion, the first support handle being pivotably connected to the first collar body portion by a first pivot member offset from the axis of the first anterior leg, the first support handle being rotatable about the first pivot member in a plane substantially perpendicular to the axis of the first anterior leg and below the first upper portion of the first side frame;

a second support assembly attached to the second anterior leg of the second side frame, the second support assembly including a second support handle and a second collar assembly having second collar body portion and a second collar clamp portion, the second support handle being pivotably connected to the second collar body portion by a second pivot member offset from the axis of the second anterior leg, the second support handle being rotatable about the second pivot member in a plane substantially perpendicular to the axis of the second anterior leg and below the second upper portion of the second side frame;

a first plurality of detents formed in the first collar body portion; and a first spring tension system disposed at least partially within a first bore in the first support handle, the first spring system adapted to engage at least one to of the first plurality of detents to secure the first support handle in a support position;

wherein the first support handle and second support handle are effective in aiding the individual rising from or returning to the seated position.

2. The walker of claim 1, wherein the first support handle and second support handle are rotatable between a neutral position and a support position.

3. The walker of claim 2, wherein the support position is between the neutral position and about 90 degrees from the neutral position internal.

4. The walker of claim 2, wherein the support position is between the neutral position and about 45 degrees from the neutral position external.

5. The walker of claim 2, wherein the second support assembly further includes means for securing the second support handle in the support position.

6. The walker of claim 1, wherein the first spring tension system comprises:

a first spring tension member;

a first bearing; and a first spring disposed between the first spring tension member and the first bearing, the first spring adapted to force the first bearing into engagement with at least one of the first plurality of detents.

* * * * *

UNITED STATES PATENT AND TRADEMARK OFFICE

CERTIFICATE OF CORRECTION

PATENT NO. : 6,990,990 B2
APPLICATION NO. : 10/376978
DATED : January 31, 2006
INVENTOR(S) : Glen R. Wilensky et al.

It is certified that error appears in the above-identified patent and that said Letters Patent is hereby corrected as shown below:

Col 6 line 60
<u>In Claim 16, line 1:</u> The word "and" should read --an--; and the word "a" should read --or--.

Signed and Sealed this

Eleventh Day of July, 2006

JON W. DUDAS
*Director of the United States Patent and Trademark Office*